United States Patent [19]

Olson et al.

[11] Patent Number: 5,048,848

[45] Date of Patent: Sep. 17, 1991

[54] IN-LINE ROLLER SKATE WITH AXLE APERTURE PLUGS FOR SIMPLIFIED WHEEL INSTALLATION

[75] Inventors: Brennan J. Olson, Eden Prairie; Thomas J. Brace, Minneapolis, both of Minn.

[73] Assignee: Rollerblade, Inc., Minnetonka, Minn.

[21] Appl. No.: 57,056

[22] Filed: Jun. 12, 1987

[51] Int. Cl.[5] ..... A63C 17/06

[52] U.S. Cl. ..... 280/11.22; 280/11.27; 301/5.7

[58] Field of Search ..... 280/11.18, 11.19, 11.2, 280/11.22, 11.23, 11.27; 301/5.7, 63 PW, 1

[56] References Cited

U.S. PATENT DOCUMENTS

| | | | |
|---|---|---|---|
| 7,345 | 10/1876 | Saladee | 301/5.3 |
| Re. 32,346 | 2/1987 | Klamer | 280/11.2 |
| 189,783 | 4/1877 | Post | 280/11.19 |
| 864,333 | 8/1907 | Pilz | 301/5.7 |
| 2,029,392 | 2/1936 | Ruske | 280/11.27 |
| 2,412,290 | 12/1946 | Rieske | 280/11.22 |
| 2,670,242 | 2/1954 | Beckman | 301/5.7 |
| 3,287,023 | 11/1966 | Ware | 280/11.2 |
| 3,880,441 | 4/1975 | Silver | 280/11.22 |
| 3,900,203 | 8/1975 | Kukulowicz | 280/11.2 |
| 3,963,252 | 6/1976 | Carlson | 280/11.22 |
| 4,054,335 | 10/1977 | Timmer | 301/5.3 X |
| 4,114,952 | 9/1978 | Kimmell | 301/5.7 |
| 4,417,737 | 11/1983 | Suroff | 280/11.2 X |
| 4,418,929 | 12/1983 | Gray | 280/11.2 X |
| 4,492,385 | 1/1985 | Olson | 280/11.22 X |
| 4,527,839 | 7/1985 | Fujitaka et al. | 301/63 PW |
| 4,603,868 | 8/1986 | Schutz | 301/1 X |
| 4,618,158 | 10/1986 | Liberkowski | 280/11.26 X |

FOREIGN PATENT DOCUMENTS

| | | | |
|---|---|---|---|
| 772044 | 11/1967 | Canada . | |
| 438121 | 7/1948 | Italy . | |
| 8104249 | 4/1982 | Netherlands . | |
| 349525 | 11/1960 | Switzerland | 280/11.23 |

*Primary Examiner*—Charles A. Marmor
*Assistant Examiner*—Tamara L. Finlay
*Attorney, Agent, or Firm*—Moore & Hansen

[57] ABSTRACT

An in-line roller skate utilizes dual position, eccentric axle aperture plugs which are received in the axle apertures of the skate frame to allow mounting of the skate's wheels in either of two distinct orientations. The plugs also solve a serious assembly problem by allowing wheels to be installed in the skate frame without the alignment problems previously encountered between frames, wheels and hard to handle spacing washers.

6 Claims, 5 Drawing Sheets

IN-LINE ROLLER SKATE WITH AXLE APERTURE PLUGS FOR SIMPLIFIED WHEEL INSTALLATION

BACKGROUND OF THE INVENTION

The invention relates to in-line or tandem roller skates and comprises a lighter, faster, and more smoothly operating in-line roller skate which is easily manufactured and more durable under both normal and extreme operating conditions including hot weather and heavy, sustained use by large adults.

In-line roller skates utilize two or more wheels positioned to rotate within a common, vertical plane and while operating as roller skates have much of the feel and behavior associated with ice skates. Substantially the same bodily movements are required to operate both ice and in-line roller skates, and such roller skates have become increasingly popular with ice skaters as a desirable training tool for off season and on-street use. In recent years, they have been capturing an increasing share of the recreational skate market and in time may parallel jogging as a healthy and pleasurable adult sport.

Tandem skates are well known and appear at least as early as 1876 in U.S. Pat. No. 7,345 of C. W. Saladee, which disclosed a two-wheel in-line model featuring a somewhat complex, spring loaded carriage supporting laterally pivoting rollers for improved maneuverability and even distribution of skater weight but was heavy, noisy and quite complicated to manufacture and assemble.

In 1946, U.S. Pat. No. 2,412,290 to O. G. Roeske disclosed a heavy metal framed, three-wheel, in-line skate for indoor use which featured an endless, rubberized belt so as to avoid damage to wooden floors. The belt rotated on three pulley-like wheels wherein the intermediate wheel was vertically adjustable to produce a rocking action in a forward or rearward direction which made it easier to steer and manuever the skate. Vertical adjustment of the intermediate wheel was achieved by a clamping bolt and a system of interlocking teeth and allowed a range of vertical adjustment.

In 1966, G. K. Ware in U.S. Pat. No. 3,287,023 disclosed an in-line skate with thin, rounded wheels which endeavored to simulate the performance of ice skates. The Ware skate utilized a fairly heavy metal frame having front and rear frame members with longitudinally extending and overlapping sections. These sections had a multiplicity of horizontally arranged axle apertures which permitted positioning of wheel axles in a variety of different locations and provided continuous adjustability of the frame to accommodate a wide variety of boot sizes. The Ware frame also included the positioning of apertures at several elevations at the front and rear of the skate so that the forward and rear wheels could be at a higher level than the two intermediate wheels. The Ware frame and variations of it are still in use on currently available in-line roller skates and has been the best all around frame available for such skates.

The Ware skate utilized a wheel formed of tough, firm but slightly soft and resilient rubber and having a central hub into which individual ball bearings were received and in which they were retained by a pair of cone elements which extended laterally from the wheel, so as to prevent contact between wheel and frame during cornering of the skate. A toe brake was utilized at the front end of the skate for stopping the skate.

U.S. Pat. No. 4,492,385 to Scott B. Olson disclosed a hybrid skate combining the desirable features of both ice and roller skates and featured a mounting system which could carry either the traditional ice skating blade or a series of in-line wheels.

Other tandem roller skates with various wheel structures and configurations are shown in U.S. Pat. Nos. 3,880,441, 3,900,203, 3,963,252, and 4,618,158. A number of distinct wheel structures have been developed for use with tandem skates, conventional roller skates and other roller devices, some of which are shown in U.S. Pat. Nos. 189,783, 2,670,242, 4,054,335 and 4,114,952.

As best shown in FIGS. 1 and 2, currently available in-line skates use a rigid, heavy metal Ware style frame 33P, which is fixed to a boot 13P and used for support of the wheels 10P. The best presently available wheels utilize an outer urethane tire member 12P which is molded about an inner, one piece hub 14P which retains left and right bearings 42P and 44P, respectively, and rotates about those bearings. The outer, annular tire member 12P is formed of relatively elastic, resilient, urethane material and closely encapsulates much of the central hub 14P. This wheel 10P, with its centrally positioned, internal hub 14P has tended to overheat during heavy use, and the urethane adjacent the hub sometimes melts and separates from the hub during sustained high speed, warm weather operation.

The hub 14P, as best shown in FIG. 2, is formed of a nylon material and has an outer annular ring 16P which is substantially concentric with an inner ring 18P, rings 16P and 18P being interconnected by four radially extending vanes 20P, which are centered on and lie within a plane 22P (FIG. 1) which vertically bisects the wheel 10P and is perpendicular to the hub's central axis 64P. The centrally positioned vanes 20P are separated by substantially equal sectors of arc and are closely surrounded and encapsulated within the urethane material of the tire member, the urethane extending through the open sectors between the vanes 20P. Left and right bearing apertures 26P and 28P are formed within the open ends of inner ring 18P and are separated by an intervening shoulder 30P, which is molded into the inner periphery of ring 18P.

Each wheel 10P is rotatably mounted between metal side rails 32P and 34P of the skate's heavy metal frame by threaded axle 36P, which passes through axle apertures 38P in the side rails. Washers 40P are positioned against the outer face of each of the bearings 42P and 44P and contact the side rails of the frame. A cylindrical metal spacer 46P is retained on axle 36P between bearings 42P and 44P. With the axle 36P inserted through the described components, as shown in FIGS. 1 and 2, and the nut 48P tightened on the threaded end of the axle, the bearings 42P and 44P have their inner races 50P tightly clamped between the washers 40P and the spacer 46P, so as to allow the outer race 52P of each bearing to rotate freely about the inner race 50P.

While the wheel 10P has better overall performance than earlier wheels, under prolonged and steady use during warm weather, and particularly by heavy skaters at high speeds, the urethane material in the areas 54P (FIG. 1A) adjacent the outer periphery of ring 18P would heat up to a temperature where the urethane would melt and begin separating from the ring 18P, thereby causing failure and eventual collapse of the wheel. This problem requires a solution which does not involve substantially changing the otherwise highly desirable and well performing urethane material from which the tire member has been formed. Providing a working solution has been further complicated by the fact that heat buildup at the melting area came in differing amounts from several sources, including the bearings themselves, from heat generated at the wheels, outer periphery by rolling friction, from heat produced by the constant flexing of the resilient tire member 12P during riding, and from heat from asphalt or concrete riding surfaces on which the wheels rotated and which in hot, sunny weather could reach temperatures in excess of 120° F.

Investigation and study by the inventor has led to the conclusion that the overheating and melting of the urethane tire member 12P is attributable principally to the arrangement of the central vanes 20P on hub 14P. When the wheel 10P rotates on a nonlevel surface, such as surface 56P (FIG. 1), the resilient urethane material of the tire member 12P tends to deform and shape itself to fit the contour of surface 56P and bulges outwardly at 58P. This bulging action generates internal forces within the urethane tire member, and as best shown in FIG. 1A, can generate a force couple 60P which can cause the outer ring 16P to cant in the direction of the force couple. This force couple 60P is transmitted along the ring 16P and through the vanes 20P to be transferred with some attenuation to inner ring 18P through vanes 20P to distort hub 14P and generate forces 62P which are applied to the bearings 42P and 44P and cause canting of the outer races 52P relative to the inner races 50P, thereby increasing the friction between inner and outer races and causing undesirable heat buildup in the bearings. The canting problem is shown in an exaggerated form in FIG. 1A for ease of visual perception. As best understood from an examination of FIG. 1A, when the outer races 52P of the bearings are cammed out of alignment, the side seals 72P and 66P on inner and outer side surfaces of the bearings are stretched or compressed. The outer side seal 66P of bearing 42P is placed in tension in area 68P below axle 36P and in compression at area 70P above the axle. Similarly, on the inner side of bearing 42P, inner seal 72P is placed in compression in area 74P below the axle and in compression in area 76P above the axle.

Similarly, bearing 44P has its outer seal 66P deformed by the canting effects with seal area 78P below the axle being placed in compression and seal area 80P above the axle being in tension. The inner seal 72P of bearing 44P is under tension at area 84P below the axle and under compression at area 86P above the axle.

The canting of the outer races and the deforming of the inner and outer bearing seals is not in practice as extreme as shown in FIG. 1A, which is exaggerated so as to permit visual perception of the problem, but such deformation is sufficient to increase friction in the bearings 42P and 44P to unacceptable levels which produce sufficient heat to melt the urethane tire members. This heat is transferred from the outer periphery of the bearing and through the thickness of inner ring 18P, which contacts the bearing, to finally heat regions 54P of the tire member to melting levels. It should be understood that this overheating problem is at its worst when the tire member is already at a high temperature from prolonged running on a hot, sun heated riding surface and when the skates carry an exceptionally heavy skater. Prolonged use of the skate over many miles of surface will further increase the heat buildup. Under extreme conditions, even the urethane surrounding outer ring 16P will melt and deteriorate.

It is desirable to provide an improved hub which avoids such overheating and is capable of high speed, heavy duty, sustained, warm weather operation by even heavy adult users on nonlevel surfaces. It is particularly important to avoid overheating caused by nonlevel surface conditions since most skating is done on nonlevel surfaces. It is relatively rare to find precisely level, flat riding surfaces and normally because of the uneven surfaces of sidewalks, streets, and the inclination of most paved surfaces for drainage, skate wheels will almost always be operating on nonlevel surfaces which apply forces which would distort the outer ring 16P of the hub 14P and normally generate varying magnitudes of unwanted canting forces which, under heavy loading, sustained riding situations, produce overheating and wheel breakdown.

Some conventional roller skates with side by side wheels have utilized hubs with inner and outer concentric rings where the outer ring is positioned adjacent the outer end of the inner ring. It is known to utilize radially positioned vanes extending between such off-centered rings and to have the vanes in planes parallel to and passing through the central axis of the concentric rings. Such an arrangement is satisfactory for the wide, rectangular cross sections of conventional roller skates but would not be usable with or function well with the thinner, rounded, in-line wheels which often operate at an angle to the riding surface.

A second shortcoming associated with presently available in-line skates is the excessive time and labor required to install or replace individual wheels. To install a new wheel on a standard metal frame 33P, like that shown in FIGS. 1 and 2, the assembler first places bearing spacer 46P within inner ring 18P and then inserts bearings 42P and 44P into apertures 26P and 28P of the hub. When the assembler thereafter attempts to insert the axle 36P through the bearings and spacer 46P, the spacer 46P will frequently have its central aperture 47P off center from the bearings, thereby making it difficult to slide the axle 36P through the wheel. To insert the axle, the assembler must manipulate the spacer with an appropriate tool or rotate the wheel about its axis to work the bearing spacer into a centered position where the axle can pass cleanly through the open center 47P of the spacer. Because the axle insertion must be done with the wheel 10P already positioned between the side rails 33P and 34P, the assembler's job is further complicated by having reduced visibility of the bearings and the need to simultaneously manipulate the entire skate frame 33P. Since each skate generally has three or four wheels, the alignment problem is encountered repeatedly and must be overcome with each wheel.

The axle alignment and insertion problem is further complicated by the difficulty of inserting the axle through a frame side rail and then aligning the spacing washer 40P which contacts the outer face of the bearing so as to permit insertion of the axle through the washer. The problem occurs again when a second washer 40P is encountered on the far side of hub 14P. Typically, the washers are difficult to keep in an orientation coaxial with the axle and, consequently, the assembler must try to manipulate the washer into position by manipulating the skate frame or inserting a small tool to move the washer about in the relatively close spacing between side rails and bearing. The collective assembly problem posed by aligning the two loose washers 40P, the bearings 42P and 44P and the loose bearing spacer 46P results in slower assembly for each of the three or four wheels on the skate, and is encountered again when a wheel must be removed for service or replacement. It is desirable to eliminate this assembly problem without adversely affecting the strength, weight, speed or smoothness of the skate's operation.

A third shortcoming of presently available skates is the heavy, metal, Ware style frame up to now required for prolonged, safe operation. While the heavy metal skate frames function acceptably, they are unattractive, susceptible to rusting, pose assembly problems and can cause scratching and marring of surfaces that are struck by the skate. The Ware style frames have multiple axle apertures arranged along the sides of the frame to assure a proper spacing for all axles when the two part frame is adjusted to the length of the boot. The Ware frame also has alternate axle apertures to allow the axles at the front and rear ends of the skate to be placed at either the same elevation as the intermediate wheels or at a slightly higher level. These many apertures, most of which are not used and are located between the actually utilized apertures, detract from the aesthetic appearance of the skate and further complicate the overall assembly of the skate frame and the installation of wheels and axles insofar as the additional apertures sometimes confuse assemblers and the axles must pass through an additional set of aligned holes in the two section frame, and any minor misalignment between confronting apertures slows up assembly.

Replacement of the hard, rigid metal frame with a lighter synthetic frame would also make the frame safer insofar as collisions between skaters and pedestrians will produce less harm when a lighter synthetic frame is used. When the skate is used indoors, elimination of the metal frame will also reduce scratching and scuffing of floors, furniture and the like.

Accordingly, it is desirable to eliminate the metal, multiple apertured, rigid frame and replace it with a lighter, more aesthetically pleasing, one piece frame which is safer, more economical to manufacture, is noncorroding and permits more rapid and simplified assembly.

In an effort to provide a faster and safer skate, it is also desirable to eliminate the hard, rigid metal frame of the known brake assembly and to replace it with a lighter, more smoothly contoured and safer synthetic brake assembly. Currently available skates have a brake attached to and extending rearwardly from the metal skate frame and consisting of a metal flange to which is attached a downwardly depending brake pad. The pad has a central threaded stud which is affixed to the metal flange with a locking nut and screw. To replace the old metal structure with a lighter but safe brake assembly formed of synthetic material, it is essential that the strength of the brake assembly be adequate for all stopping purposes and that the synthetic components be designed to withstand sheer forces and strains.

SUMMARY OF THE INVENTION

An improved, in-line or tandem roller skate features a new wheel structure capable of sustained, high speed usage by heavy adult skaters in even hot summer temperature conditions and solves the meltdown problems associated with known in-line urethane wheels without changing the desirable urethane wheel material which has gained broad commercial acceptance.

The improved wheel structure utilizes a central hub having inner and outer, generally concentric rings which are interconnected by substantially rigid vanes which are positioned transverse to the common plane along which the wheels are arranged. Each vane is preferably positioned in a plane which passes through the central axis of the wheel axle and lies along a radius of the wheel. The use of such vanes substantially eliminates the undesirable canting effect which resulted in increased bearing friction when the wheels were operated on nonlevel surfaces. The new hub configuration allows the bearings to operate at a lower temperature and thereby eliminates the excessive heat buildup responsible for wheel meltdown.

The wheels are rotatably mounted to a structurally improved, lightweight, one piece frame formed of synthetic material which significantly reduces frame weight while providing strength formerly available only from metal frames, improves overall performance and appearance and eliminates time consuming assembly problems. The lighter, more streamlined frame has elastic flexing properties which assist the skater in pushing off and results in a faster skate which is less prone to injure pedestrian or property during minor collisions.

An improved series of cooperating bearing sleeves, eccentric plugs and elongated axle apertures reduce the assembly time and cost and result in a faster, smoother running and more quiet skate. The use of dual position eccentric plugs, which are received into elongated axle apertures in the frame, enable each axle to occupy two distinct axle positions relative to the frame while passing through only a single pair of axle apertures. The dual position plugs allow the center wheel or center pair of wheels to be placed at a slightly lower level than the front and rear wheels to produce the rocking action expected and utilized in prior art skates for steering and maneuvering, but accomplish this goal without the use of additional axle apertures which would weaken the frame or detract from its aesthetic appearance.

The improved bearing sleeve eliminates the problem of axle alignment and insertion through the left and right bearings of each hub by having the bearing sleeve pass outwardly through the central aperture of each bearing, thereby providing a smooth, continuous axial passage extending fully between the sides of each wheel. The dual position eccentric plugs replace the washers used with the Ware frame and utilize laterally extending lugs which are mateably received into elongated apertures in the frame, thereby retaining the plugs in a first position in the frame while each wheel is inserted in the side rails of the frame. Use of the plugs eliminates the slippage and misalignment which occurred between the frame and the now eliminated washer and avoids the slow and tedious assembly process associated with prior art skates.

The cooperating eccentric plugs and the bearing sleeve isolate the hub and the bearings from the metal axle and provide a shock absorbing and noise avoidance effect to absorb road impact roughness, to eliminate much of the noise and produce a substantially smoother running and more quiet skate.

A new lightweight brake assembly is formed of synthetic material and achieves the strength and durability of prior art metal framed brakes by utilizing a brake pad and brake housing which have an interacting annular ridge and slot to assure even distribution of sheer forces generated during braking and thereby avoid fracture or other damage to the lightweight brake housing.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 3:
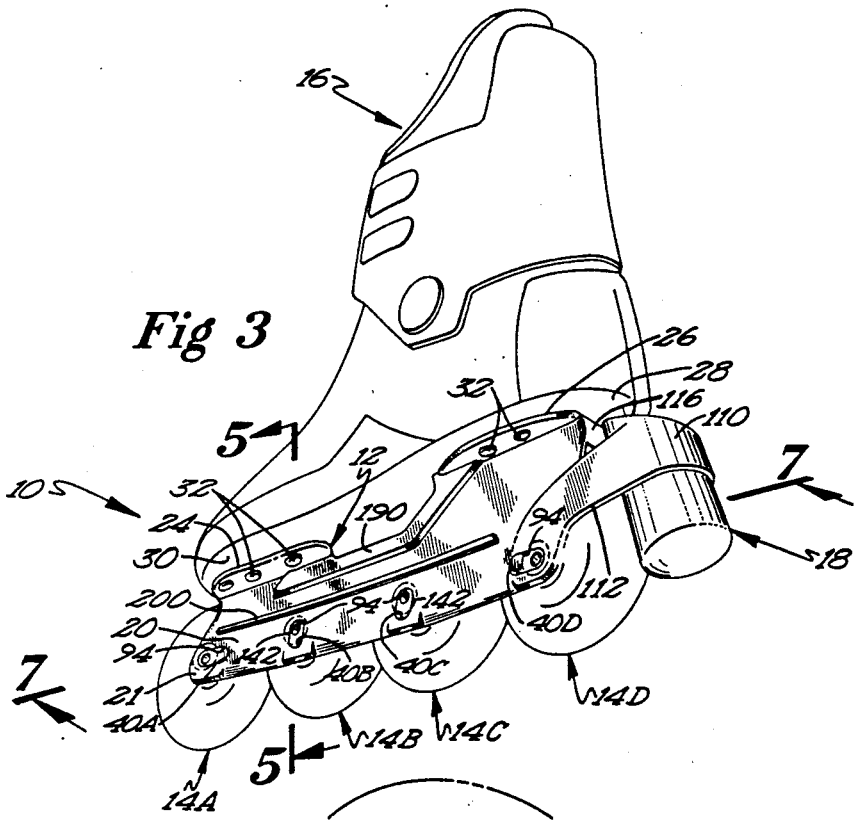
FIG. 3 is a side perspective view of an in-line roller skate embodying the invention and in which the heads of axle bolts have been deleted to more fully display the skate frame.

Referring now to FIG. 3, an in-line roller skate 10 embodying the invention includes an elongated, lightweight, elastic frame 12 to which a plurality of substantially identical in-line skate wheels 14A, 14B, 14C and 14D are rotatably mounted. The frame 12 carries a brake assembly 18 at the rear thereof and is mounted to a boot 16 which provides protection and support to the foot and ankle of the skater. While the shown boot 16 provides one type of attachment means for releasably securing the frame 12 to a skater, it should be understood that other boots, shoes, straps or clamps can be substituted, and are within the purview of the invention.

A pair of front axle apertures 40A (FIGS. 3 and 8) are positioned adjacent the front end of the frame 12 with an aperture 40A being positioned in side rail 20 and a second aperture 40A being positioned in side rail 22, the apertures 40A generally confronting one another and coaxial with wheel axle 74A associated with front wheel 14A. A pair of rear axle apertures 40D are situated near the rear of frame 12 with an aperture 40D being positioned in side rail 20 and a second aperture 40D in side rail 22 with the apertures confronting one another and coaxial with axle 74D associated with rear wheel 14D. The axle apertures 40A and 40D have an oblong, or oval configuration which will be described further hereafter and are positioned at equal distances upwardly of the lower edges or bottom 41 of the frame side rails.

Two pairs of intermediate axle apertures 40B and 40C are positioned between the forward and rearward apertures 40A and 40D, an aperture 40B being positioned on each side rail 20 and 22 and the apertures 40B confronting each other and coaxial with wheel axle 74B which mounts wheel 14B. Similarly, an intermediate aperture 40C is positioned on side rail 20 and a second aperture 40C on rail 22, the two apertures 40C confronting each other and being coaxial with the wheel axle 74C associated with wheel 14C. All the apertures 40B and 40C have an oblong, or oval configuration extending generally vertically and interact with axle plugs, described hereafter, to position the intermediate wheels 14B and 14C in either a lower or upper position. The upper edge 94 of all eight axle apertures of the side rails is positioned to lie in a single, common, horizontal plane so that when axle plugs are inserted in the apertures in a first orientation, described hereafter, all the wheels will be perfectly aligned with their axles having their axes in a common plane parallel to the riding surface 39.

Figure 7:
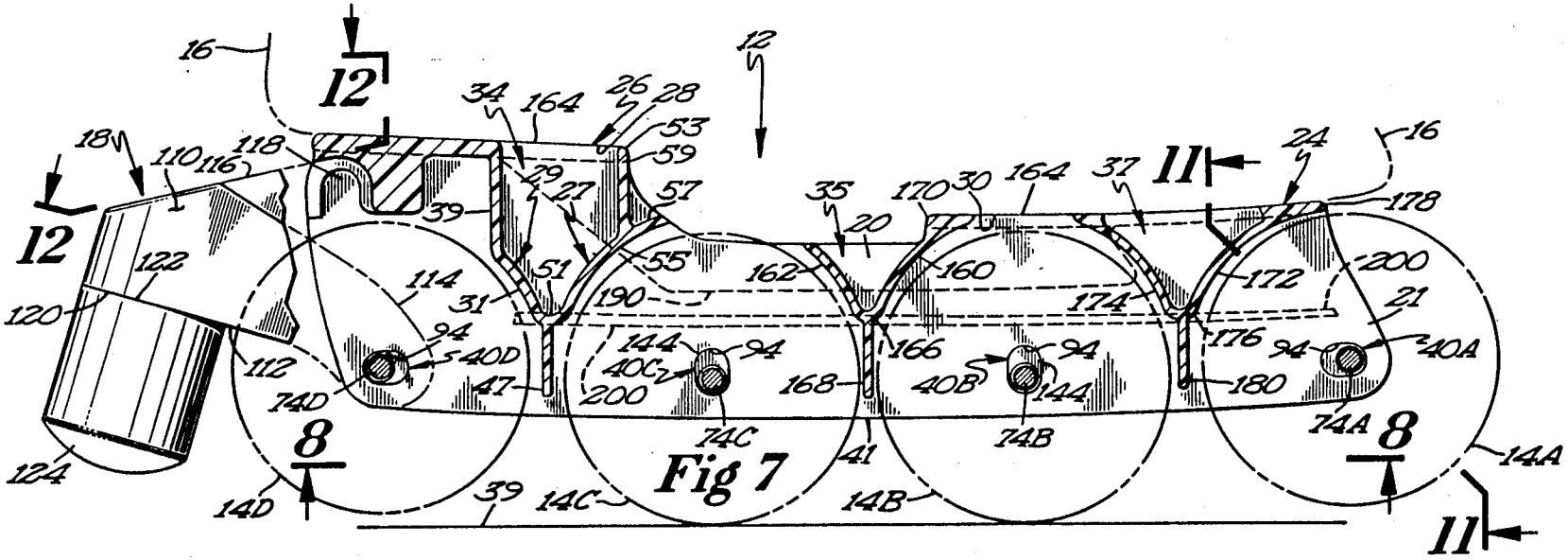
FIG. 7 is a cross sectional side view, and partially in phantom, of an in-line skate frame embodying the invention and taken in the direction of cutting plane 7—7 of FIG. 3.
Figure 8:
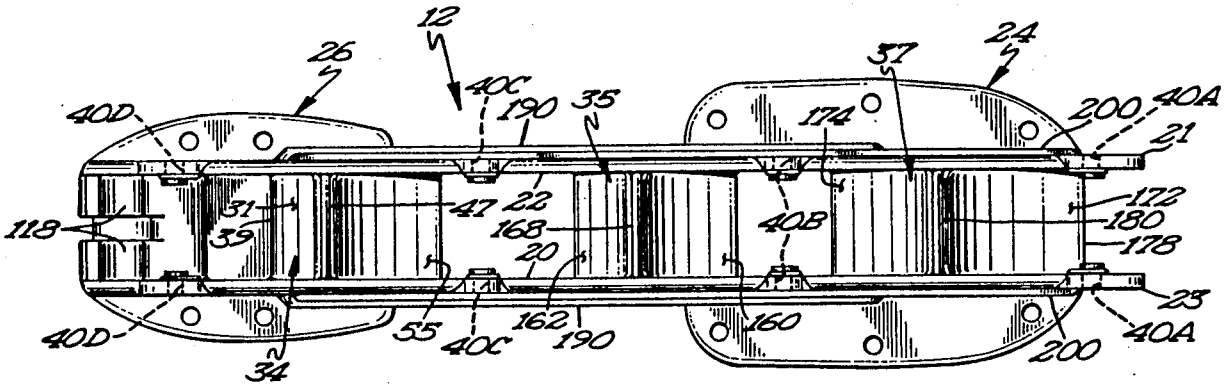
FIG. 8 is bottom view of the frame of FIG. 7.

The frame 12 is preferably formed by injection molding using a plastic material such as impact modified, glass reinforced nylon or the like and is preferably an integral body having longitudinally extending parallel side rails 20 and 22, each of which have laterally extending mounting brackets 24 and 26 at the front and rear, respectively, of the frame and bear against the sole 30 and heel 28 of the boot. Two or more rivets 32 may be used to securely fix each edge of the brackets to the boot. As best shown in FIGS. 7 and 8, three transversely oriented, bifurcated webs 34, 35, and 37 are spaced longitudinally along the frame from each other and extend between side rails 20 and 22 with a web being positioned between each adjacent pair of wheels to strengthen the lightweight side rails of the frame 12.

In providing an effective but lightweight frame of synthetic or plastic material, it is important to utilize a supportive and self-reinforcing frame which can handle the often severe impacts and strains which are encountered over rough riding surfaces. While the older heavy metal frames of the prior art skates could absorb these impacts without special design, a faster, more maneuverable, lightweight frame must anticipate the areas of severe stress and provide special strain absorbing and distributing structures without significantly increasing weight. Each of the bifurcated webs is slightly different in configuration to meet the special loading requirements of a lightweight frame.

As best seen in FIG. 7, heel web 34 includes forwardly and rearwardly extending bifurcations 27 and 29, respectively, which have a convergence 51 and are connected to and extend between side rails 20 and 22. Rearward bifurcation 29 extends upwardly and rearwardly from the convergence 51 and includes substantially vertical wall segment 39 which extends from heel bracket 26 downwardly to join converging segment 31. The forward bifurcation 27 has a converging segment 55 which extends upwardly and forwardly from the convergence 51 and meets vertical segment 59 which extends to the heel bracket 26, where it joins the leading edge 53 of that bracket. Bifurcation 27 further includes a rigid instep bar 57 which extends forwardly from converging segment 55. A vertical wall segment 47 extends downwardly from the convergence 51 and ends adjacent the bottom 41 of the frame. All of the described portions of heel web 34 extend between and are connected with and reinforce the side rails 20 and 22 to maintain the parallelism of the side rails and to assure that forces generated by bumps and road irregularities do not cause deformation of the side rails which might cause the axles to become nonparallel to each other. Having the upper ends of forward and rearward bifurcations 27 and 29 contact and bear against the sole of the boot also helps strengthen the frame and reduce unwanted frame deformation and strain while providing a safer, more lightweight, faster frame.

Intermediate web 35 has forwardly and rearwardly extending bifurcations 160 and 162, respectively, which begin at convergence 166 and extend upwardly to the top 164 of the frame where bifurcation 160 joins the trailing edge 170 of sole bracket 24 to reinforce the sole bracket. Web 35 includes a vertical wall segment 168 which drops downwardly from convergence 166 and terminates adjacent the bottom 41 of the frame. The segments 160, 162 and 168 which make up web 35 extend between and are connected with side rails 20 and 22 and reinforce the sidewalls to assure that no significant deformation of the side rails occurs in the midportion of the frame, thereby keeping both the side rails parallel to each other and the wheel axles mutually parallel, so as to avoid bearing friction which might result from nonparallel axle alignment.

The forward or sole web 37 has forwardly and rearwardly extending bifurcations 172 and 174 which meet at convergence 176 and extend upwardly to the top 164 of the frame. The forward end of bifurcation 172 joins the leading edge 178 of sole bracket 24 and the upper ends of the bifurcations 172 and 174 both bear against the sole 30 of the boot 16 to further reinforce the frame 12. Bifurcated web 37 has a vertical wall segment 180, which begins at convergence 176 and extends downwardly to terminate adjacent the bottom 41 of the frame. The bifurcations 172 and 174 and segment 180 extend between and are connected with side rails 20 and 22 and inhibit road incurred vibration or distortion of the side rails due to road bumps, and which would cause the axles to become nonparallel while the skate is coasting on the its wheels.

It has been found desirable to have the lower end of each of the segments 47, 168 and 180 extend downwardly below the axle apertures so as to provide reinforcement to the frame at levels below the axles. Without such support and with a lightweight frame, the rails can, under some road conditions, receive severe stress and eventually fracture and separate from the webs.

Each of the webs 34, 35 and 37 is positioned such that its downwardly extending wall segment 47, 168 and 180, respectively, is substantially equidistant between the two axle apertures nearest the segment. For example, segment 47 is a substantially equal distance between apertures 40C and 40D. Because of this equidistant positioning, the three webs cooperate with the axles to grip the side rails 20 and 22 therebetween each axle and its nut 104, compressing the side rails against the webs to deter fracture between the webs and the side rails and to assure parallelism between the side rails and parallelism between the axles, for smooth, reduced friction operation of the lightweight skate. As a result of the rigid support provided for the frame by each axle, as described hereafter, the side rails are rigidly interconnected at seven substantially equally spaced positions therealong, namely at the four axle apertures and at the three webs.

Each of the webs has the shown bifurcations which join and cooperate with the side rails to form a triangulating truss or Y-beam support positioned between adjacent wheels defined by the segments which extend outwardly from the three convergences 51, 166 and 176. These structures are extremely strong and rugged, enabling the synthetic frame to absorb impact that has previously required metal frame members. The use of the six diverging bifurcations 176, 174, 160, 162, 27 and 29 assures that stress and vibration from road roughness are transferred to the boot at fairly evenly spaced intervals along the skater's foot.

An elongated reinforcement bar 200 is positioned on the outside of each side rail and above each of the three leading axle apertures 40A, 40B and 40C to add reinforcement to the three most forward wheels where the most heavy road stress is encountered. As best shown in FIG. 7, the bar 200 is situated on the outside of each side rail such that it lies opposite the convergences 51, 166 and 176, so as to further strengthen the side rails and reinforce the webs.

Since most experienced skaters use skates which are supported on intermediate wheels 14B and 14C (which are often at a lower level than wheels 14A and 14D as described hereafter), the shown bifurcations and cooperating side rails must absorb most road generated forces through intermediate wheels 14B and 14C, and then evenly spread those forces throughout the frame and to the foot of the skater. Referring now to FIGS. 3, 5, 7 and 8, each side rail includes a strong, widened bridge member 190 which extends along the outside of the rail above wheels 14B and 14C to reinforce the heel, intermediate and sole webs 34, 35 and 37, respectively, so as to better absorb forces imparted from intermediate wheels 14B and 14C and spread them more evenly through the bridge members 190 to the rest of the frame. The front and rear ends of the bridge members join the sole and heel brackets, respectively, and provide support for those brackets. These bridge members do not extend to forward segments 21 or 23, which are intended to remain more flexible for reasons described hereafter.

Because the intermediate wheels 14B and 14C will frequently absorb the most road shock, the webs 34, 35 and 37 are configured to specially absorb and evenly distribute those shocks. Heel web 34 has its forward bifurcation 55 and 57 curving forwardly above wheel 14C and has a radius of curvature centered on aperture 40C. Rearwardly extending bifurcation 162 of web 35 has an identical radius of curvature about aperture 40C.

The segments 47, 55, 162 and 168 closely surround much of the wheel in order to receive forces and shock radiating outwardly from axle aperture 40C and caused by road vibration and bumps. This cooperation between the segments 47, 55, 57, 162 and 168 makes the frame significantly stronger while adding little weight and permits the lightweight synthetic frame 12 to perform the supportive role that in the past required heavy, metal frames.

Similarly, the segments 160 and 174 of webs 35 and 37, respectively, have a common radius of curvature centered on axle aperture 40B and converge to overlie wheel 14B. The segments 168, 160, 174 and 180 closely surround much of wheel 14B so as to receive the forces and shock which radiate outward through the frame from axle aperture 40B during operation. The cooperation between these segments makes the frame significantly stronger and contributes to the successful operation of the lightweight synthetic frame 12 and its replacing of the traditional, heavier metal frames.

Figure 11:
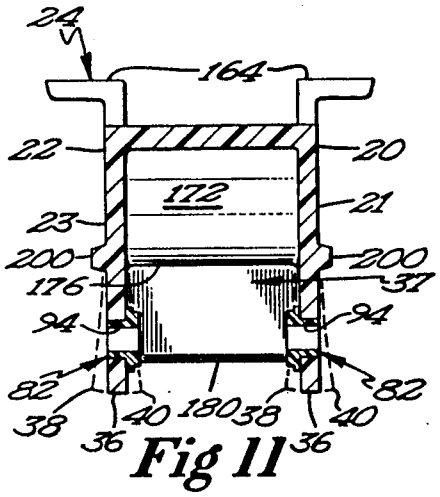
FIG. 11 is a front view of the frame showing alternative flexed positions of the forward segment during push-off by a skater and taken in the direction of arrows 11—11 of FIG. 7.
Figure 12:
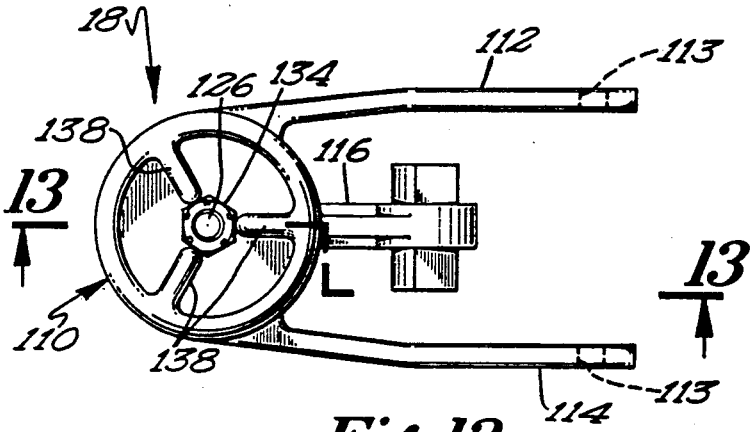
FIG. 12 is a top view of a brake assembly embodying the invention and taken in the direction of cutting plane 12—12 of FIG. 7.
Figure 13:
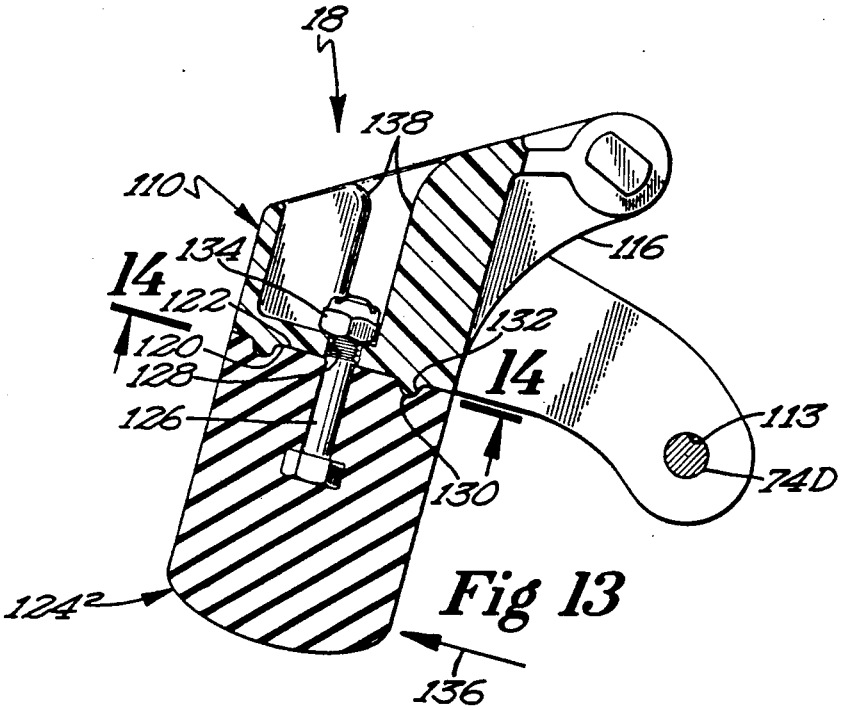
FIG. 13 is a side cross sectional view of the brake assembly of FIG. 12 and taken from the direction of cutting plane 13—13 of FIG. 12.
Figure 14:
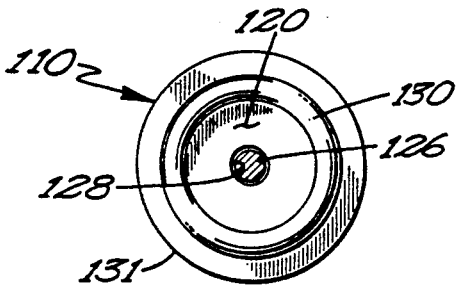
FIG. 14 is a bottom view of a part of the brake assembly of FIG. 13 and taken in the direction of cutting plane 14—14 of FIG. 13.

Side rails 20 and 22 include front end fenders 21 and 23, respectively, which extend forwardly of sole web 37 and allow the skater to generate extra acceleration during push off from the riding surface. Because of the elastically flexible characteristic of the lightweight, synthetic material of the frame, the fenders 21 and 23 are capable of flexing between the shown rest position 36 (FIG. 11) to either of two displaced positions 38 or 40 located lateral to the rest position. Lateral displacement of the fenders occurs when the skater uses forward wheel 14A to push off against a riding surface 39 to generate forward acceleration during skating. When such pushing off occurs, the fenders 21 and 23 are flexed from rest position 36 to the displaced position 38 or 40, depending upon whether push off is by the right or left skate, and a restoring force is generated in the side rail fenders 21 and 23, which tend to spring back to rest position 36. In the process of returning to rest position, the fenders exert a reaction force on riding surface 39 through the wheel 14A and provide a further pushing off effect which generates additional acceleration. Longitudinal ribs 200 provide sufficient reinforcement to keep the fenders 21 and 23 in parallel alignment with side rails 20 and 21 during coasting on the wheels but allow enough lateral flexing to permit the displacement of the fenders to position 38 or 40 during push-off.

While specific bifurcated webs and bridge members have been shown herein, it should be understood that the webs may be varied somewhat in configuration and location. In some applications, as when the invention is embodied in a three wheel skate, a pair of webs may be used instead of the three webs described with the embodiment 10. All such variations are within the purview of the invention.

The lightweight frame 12 with its described structural components can thus effectively replace the heavier metal frames used in prior art skates and can effectively withstand the road forces and strains encountered under normal and adverse conditions. Utilizing the invention embodied in the lightweight frame 12 permits the weight of each skate to be reduced significantly, frequently by ten to thirteen ounces per skate, making each skate much faster, more maneuverable and less tiring to use.

Each of the wheels 14A, 14B, 14C and 14D is substantially identical in construction and operation and is centered between side rails 20 and 22 on a common plane 54 (FIG. 5), with the central axis 52 of rotation being perpendicular to plane 54. It is also to be understood that the axles 74A, 74B, 74C and 74D are identical and so also are the axle aperture plugs, bearing sleeves and bearings associated with each wheel and described hereafter. Because of the identical nature of the wheel mounting components, only those associated with wheel 14B will be described in detail.

Referring now to FIGS. 3–6, wheel 14B has an outer tire member 42 formed of an annulus of resilient, yieldable, riding surface engaging urethane material which is molded about and closely encapsulates the outer portion of an integral central hub 44, which rotates about central axis 52 of the wheel. The wheel has an outer tire rim 214 whose cross section is substantially semicircular (FIG. 5) with the center of the semicircle being positioned on the common plane 54.

The hub 44 is molded of plastic or other suitable synthetic material such as impact modified nylon and has a first or outer substantially rigid ring 46 which is concentric with a second, smaller inner ring 48. The substantially rigid rings 46 and 48, which are preferably cylindrical, are interconnected by a plurality of substantially rigid vanes 50, which are molded integrally with the hub and separated by substantially equal sectors of arc about the periphery of inner ring 48. The vanes 50 are substantially the same width as the outer ring 46 and extend between and interconnect the rings 46 and 48. Ring 46 has a side to side width extending between edges 218 and 220, and this width is substantially centered on common plane 54 on which the wheels are centered. Similarly, ring 48 has a side to side width extending between edges 222 and 224 and its width is also substantially centered on plane 54. This centering of the rings is important to permit the wheel to operate in the in-line skate without creating excess forces on one or the other of the bearings and overheating of the bearings.

Each of the vanes is preferably positioned to be within a plane which is parallel to and intersects the wheel or hub axis 52. These rigid vanes 50 strongly reinforce the inner and outer rings and, during operation of the skate, prevent the outer ring 46 from canting or shifting its orientation in a manner which would make the rings 46 and 48 nonconcentric. While it is preferred that the vanes be within planes which both intersect and are parallel to the axis 52, the vanes will function satisfactorily if they are oriented transversely to the common plane 54 which is perpendicular to each wheel axis 52.

The outer ring 46 and the vanes 50 are wholly contained within and encapsulated by the molded urethane tire member 42 which surrounds the outer portion of hub 44. The inner ring 48 is of greater width than ring 46 and extends fully between the sides of the wheel 14B.

Figure 1:
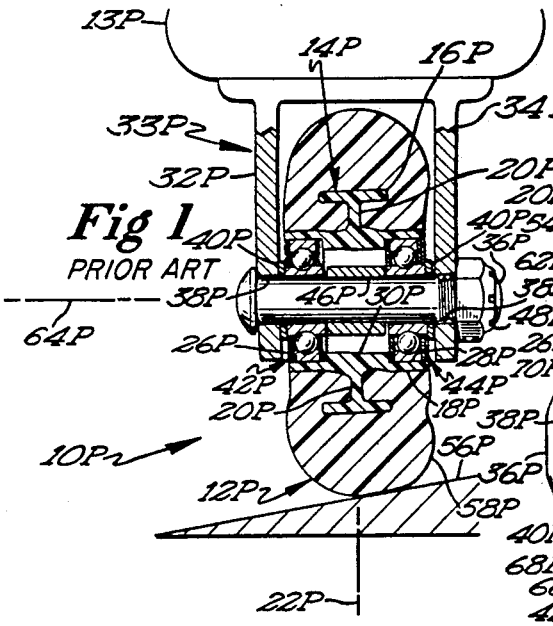
Fig 1 PRIOR ART
FIG. 1 is a cross sectional, front end view of a prior art in-line roller skate showing the mounting and internal structure of an in-line wheel and showing the undesirable canting of the wheel's hub when the skate is operated on a nonlevel riding surface.
Figure 1A:
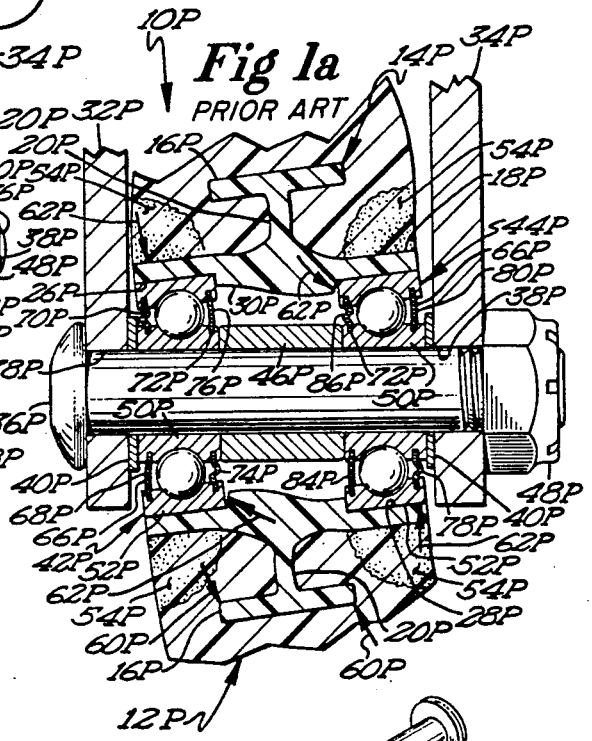
Fig 1a PRIOR ART
FIG. 1A is an enlarged view of the hub and bearings used on the prior art wheel of FIG. 1 and showing the undesirable deformation of the wheel bearings when the hub is canted by operation on a nonlevel riding surface.
Figure 2:
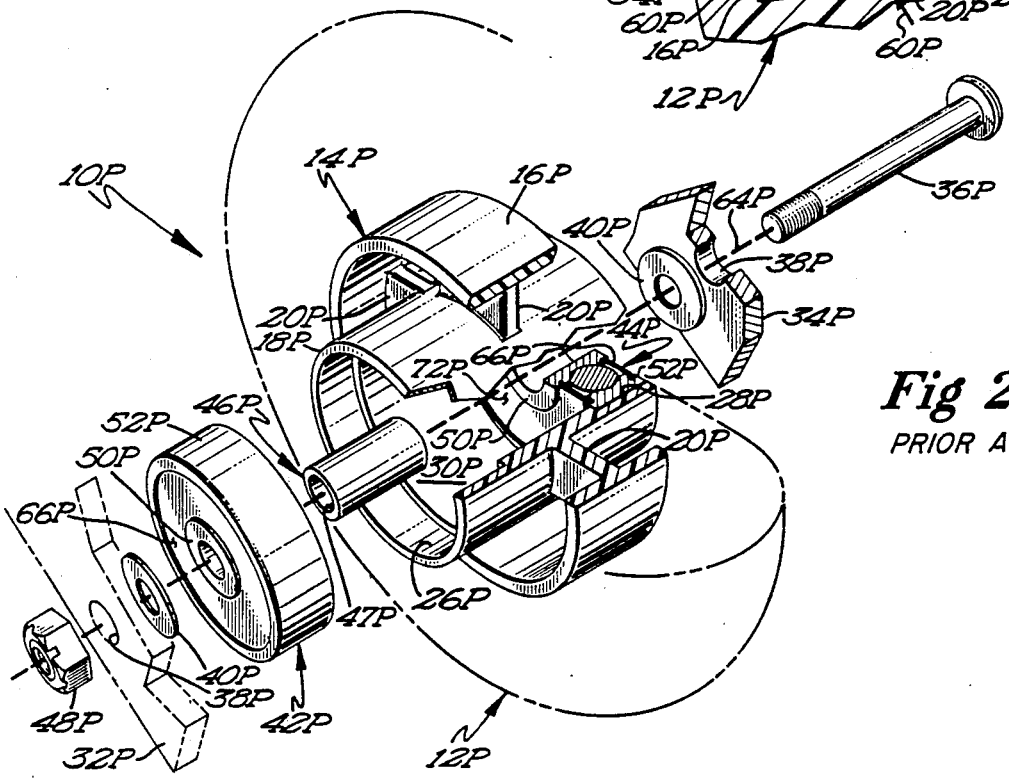
Fig 2 PRIOR ART
FIG. 2 is an exploded, perspective view, taken partly in section and in phantom and showing the hub and wheel mounting arrangement utilized in the prior art skate of FIG. 1.
Figure 5:
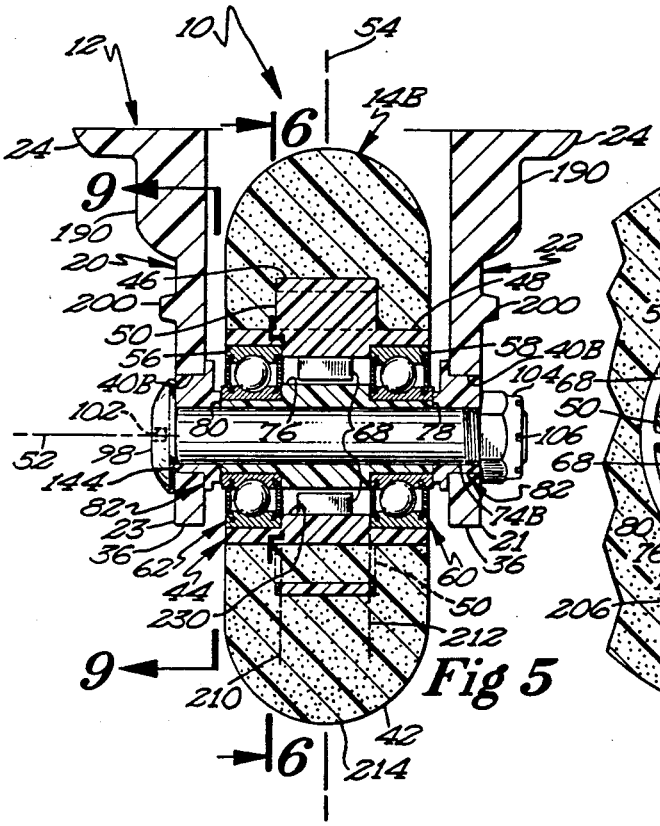
FIG. 5 is a cross sectional end view of a hub and wheel embodying the invention and taken in the direction of cutting plane 5—5 of FIG. 3.
Figure 6:
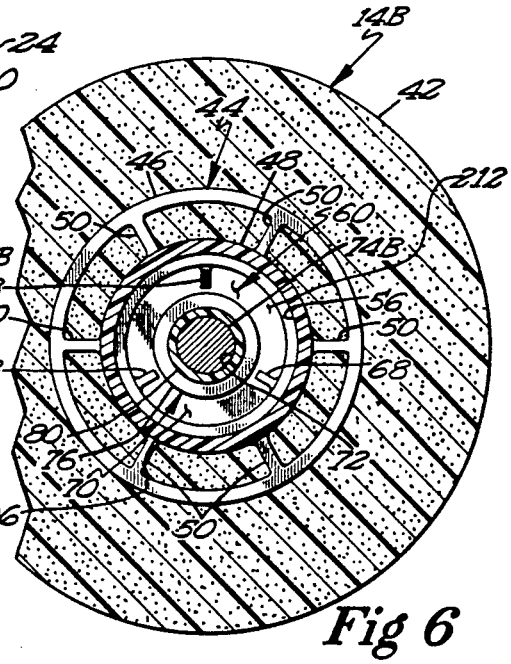
FIG. 6 is a cross sectional side view of the wheel and hub of FIG. 5 and taken in the direction of cutting plane 6—6 of FIG. 5.
Figure 4:
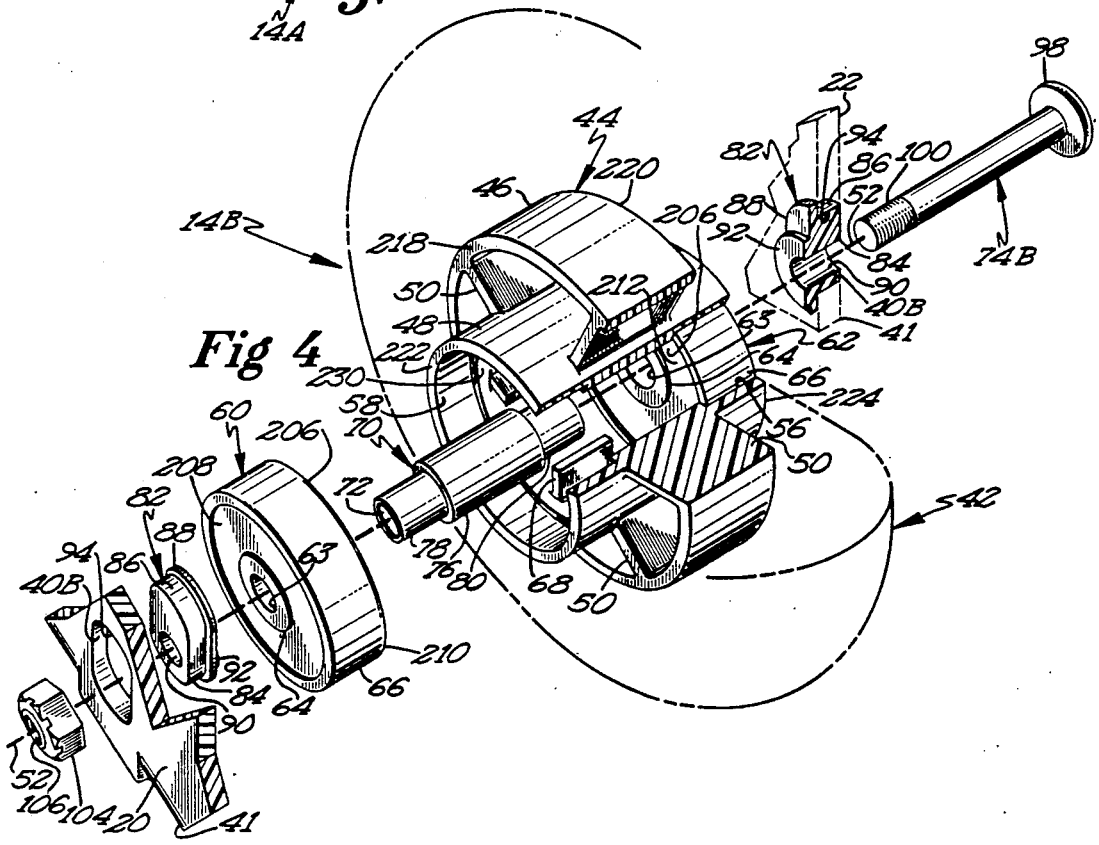
FIG. 4 is an exploded perspective view taken partly in section and in phantom and showing a new hub and wheel mounting structure for an in-line roller skate which embodies the invention.

Inner ring 48 has left and right bearing apertures 56 and 58 into which substantially identical left and right bearings 62 and 60 are received and frictionally retained. As best shown in FIG. 4, each of the bearings 60 and 62 has a central axle bore 63, an inner race 64 and an outer race 66. Referring now to FIGS. 4 and 5, each bearing has an outer face 208 and an inner face 206, and the inner face is positioned in the hub 44 adjacent bearing abutment 230. The abutment 230 is centered on common plane 54 and has a width less than that of ring 46. The flat inner face 206 of bearing 62 defines a first bearing plane 210, and the inner face 206 of second bearing 60 defines a second bearing plane 212. These bearing planes are parallel to each other, and the bearings 60 and 62 are positioned in the hub so these bearing planes 210 and 212 intersect the outer ring 46 and vanes 50 with the ring 46 and the vanes 50 extending laterally beyond the bearing planes (FIG. 5) so as to overlie the bearings. This positioning supplies valuable support for an in-line skate wheel during heavy operation. The two bearings 60 and 62, collectively comprise one type of bearing means usable with the invention. While a specific pair of bearings has been shown as satisfactory and as preferred with the hub 44, it should be understood that other bearings or a single bearing may be substituted with appropriate hub modification and is within the purview of the invention.

While six radial vanes 50 have been shown as being used in the preferred embodiment of the invention, it should be understood that lesser or greater numbers of such vanes may be used and are within the purview of the invention. For example, three, four, or five vanes may be used with the hub and provide somewhat less effective support for the outer ring 46, but do reduce the amount of canting of the outer ring to a level less than that of the prior art hub 14P. Correspondingly, a number greater than six vanes may also be utilized to provide additional support for the outer ring.

A bearing sleeve 70 formed of low friction, acetate resin, having a crystalline plastic composition and manufactured by Du Pont De Nemours EI & Co. has been found to be effective. The sleeve is generally cylindrical in configuration and has a central sleeve bore 72 closely surrounding axle 74B. In the middle of the bearing sleeve is a raised central shoulder 76, which abuts against the inner races of the bearings 60 and 62 to space the bearings apart. The shoulder has a length substantially equal to the distance between the bearings 60 and 62 when they are properly positioned in the bearing apertures 56 and 58 of hub 44. Cylindrical end sections 78 and 80 of the sleeve are of a suitable diameter and length to permit them to be inserted within and frictionally engage the inner races 64 of bearings 60 and 62 to isolate the axle bore 63 of the inner race from the axle 74B, so as to obtain smoother and more quiet running of the bearings on axle 74B and to provide a shock absorbing medium between axle and bearings.

Inwardly extending radial guides 68 extend from the inner periphery of the hub ring 48 toward the central axis 52 to facilitate the insertion and centering of the bearing sleeve 70.

Referring now to FIGS. 4, 5 9 and 10, an axle aperture plug 82 is positioned on each side of the hub 44 and is mateably received within each of the axle apertures 40B of the frame 12. The plug 82 has a laterally extending, generally oblong lug 84, whose outer periphery 86 is mateably, frictionally received and retained in each axle aperture of the frame 12. The lug 84 has a length substantially equal to the thickness of the side rails 20 or 22 of the frame so as to completely fill the axle aperture from one side of the side rail to the other. A collar 88 extends radially outwardly from the lug 84, bears against the inner surface of the adjacent side rail, and provides a convenient means by which an installer can easily remove the plug from the axle aperture when necessary to adjust the wheels.

Figure 9:
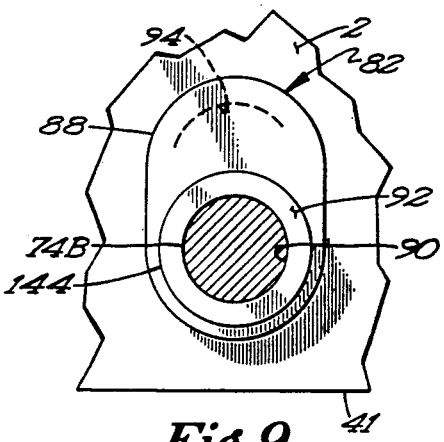
FIG. 9 is a partial cross sectional side view of the frame and axle showing an embodiment of an axle aperture plug in a first operating position and taken in the direction of cutting plane 9—9 of FIG. 5.
Figure 10:
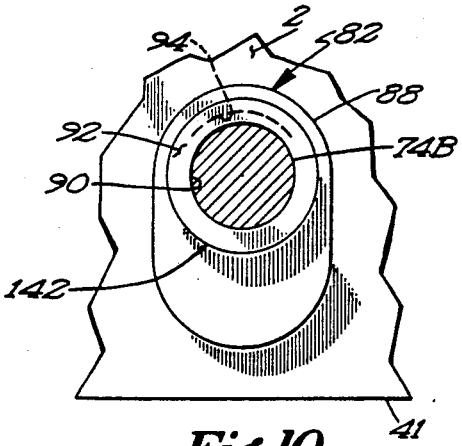
FIG. 10 is a partial side view of the same subject matter shown in FIG. 9 and wherein the plug is in a second operating position.

An axle bore 90 passes entirely through lug 84 and is sized to receive axle 74B therein. The bore 90 is positioned eccentrically on the oblong lug and has a spacer such as raised annular rim 92 encircling the bore 90 and extending laterally along axle 74B toward the hub, as best shown in FIGS. 4 and 9. When a plug 82 is positioned in axle aperture 40B, the annular rim 92 provides a washer-like mechanism which contacts the inner race 64 of the adjacent bearing and thereby assures necessary clearance between the outer race 66 of the bearing and the side rail 20 or 22 of the frame.

The axle plug 82 may be inserted into the axle apertures 40B and 40C in either of two distinct orientations. In a first orientation 142 shown in FIGS. 3 and 10, the axle bore 90 of the plug is positioned in each aperture 40B and 40C at a first distance below the upper edge 94 of the axle aperture. In this first orientation 142, the axes of all four axles 74A, 74B, 74C and 74D, when inserted in the plugs, lie in a single plane, and all four wheels are in full contact with the riding surface, as shown in FIG. 3. Alternatively, the plugs 82 in apertures 40B and 40C may be rotated 180° to be in a second orientation 144 (FIGS. 5, 7 and 9), with their axle bores 90 located further away and downward from the upper edge 94. In orientation 144, the axles of the two intermediate wheels 14B and 14C are at a lower level closer to the riding surface 39 than the axles 74A and 74D of wheels 14A and 14D so that the skate is supported on intermediate wheels 14B and 14C. It should be understood that the axle apertures 40A and 40D are preferably positioned in frame 12 to have their oblong configuration extend horizontally, rather than vertically, such that when plugs 82 are positioned therein in any orientation, the axle bore 90 will always be at the same distance from upper edge 94 of the axle apertures.

Accordingly, it should be understood that the axle aperture plugs 82 permit the intermediate wheels 14B and 14C to be selectively located at two distinct alternative levels 142 or 144 and also solve a second problem associated with prior art skates, in that because the plugs are frictionally retained in the axle apertures, the metal washers previously associated with in-line skates and which frequently slipped out of position or fell from the frame during wheel installation, are no longer used and are fully replaced by the annular rims 92 of the plugs which serve effectively as a washer substitute.

It will be appreciated that the axle apertures 40B and 40C are shaped so the axle aperture plugs may be mateably inserted therein with either described orientations 142 or 144. The apertures and plugs are shaped so the plugs cannot rotate between these two positions or orientations without first being manually withdrawn from the apertures and manually rotated by the operator. The oblong configuration of the apertures and the plugs comprise one type of anti-rotation means for selectively maintaining the plugs in predetermined orientation. It should be understood that the axle apertures and mating plugs need not be oblong or oval and could instead be square, rectangular, triangular or any other regular or irregular geometric configuration which resists unwanted rotation. All such anti-rotation alternative configurations are within the purview of the invention.

While the axle aperture configuration shown for frame 12 in FIGS. 3 and 7 is one workable combination in which the present invention may be practiced, it should be understood that other alternatives may be utilized. For example, the axle apertures 40A and 40D could have their oblong configuration oriented vertically just as apertures 40B and 40C are oriented and with the uppermost edges of apertures 40A and 40B at the same level as the upper edges 94 of apertures 40B and 40C. The same rocking action for wheels 14B and 14C could then be obtained by placing the plugs of apertures 40A and 40D in position 142 and the plugs of apertures 40B and 40C in position 144.

Each of the axles 74A, 74B, 74C and 74D is substantially identical and formed by a bolt having a wide, smoothly contoured head 98 and a threaded end 100. The head 98 is preferably provided with a countersunk allen socket 102, as shown in FIG. 5. A nut 104 with an integral lock nut mechanism 106 is threadably received on bolt end 100. The nut may, if desired, be provided with an integral washer. The head 98 and nut 104 collectively comprise a clamping means on the axle by which the axle aperture plugs 82, sleeve 70 and inner races 64 of the bearings may be tightly retained on the skate frame. When the bolt and nut are tightened, the clamping effect forces the annular rims 92 of the axle aperture plugs against the inner race 64 of each bearing and the bearing against the ends of raised shoulder 76 of bearing sleeve 70, thereby securely retaining the inner races of the bearings. The outer race of each bearing then rotates freely about the axle to permit easy and fast rotation of the wheels.

Referring now to FIGS. 7 and 12–14, a brake assembly 18 is molded of impact modified glass reinforced nylon, positioned at the rear of the frame 12 and has a generally cylindrical housing 110 from which a pair of forwardly extending, lateral arms 112 and 114 overlie the frame side rails 20 and 22, respectively, and are clamped in place on rear axle 74D, which passes through holes 113 in the arms. The arms 112 and 114, while clamped on the axle 74D, reinforce and stabilize the side rails 20 and 22 and inhibit lateral flexing of the side rails at the rear of the frame. A strut 116 engages and is retained within a socket 118 in the frame 12. Situated at the bottom of the housing 110 is a downwardly facing housing mounting surface 120, which confronts and engages pad mounting surface 122 of brake pad 124. The brake pad has a central threaded bolt 126 which extends outwardly and passes through central aperture 128 in the housing mounting surface 120. The housing mounting surface 120 is provided with a raised, annular wedge or rib 130 which is spaced inwardly from the outer edge 131 of the pad and which closely engages an annular slot 132 formed in the mounting surface 122 of the pad. When the mounting surfaces are tightly abutting and the housing and pad clamped together by threaded rod 126 and nut 134, the annular rib 130 and slot 132 are interlocked, and any lateral sheer force in direction 136 is evenly absorbed throughout the area of the rib and slot, thereby avoiding the concentration of such forces around the rod 126 and any problems with fracturing of the brake housing. A plurality of internal reinforcement gussets 138 are provided to further strengthen the cylindrical housing 110.

While the invention has been described as operating on streets and roads, it should be understood that use should be limited to riding surfaces which are safe for the skater and where minimal motor vehicle traffic will be encountered. Sections of road, street or trails which are devoted to bicycle traffic are often suitable for the in-line skate.

While the invention has been shown as embodied in a four wheeled skate, it should be understood that more or less wheels may be used, and a three wheeled skate is highly desireable for some training situations. All such variations are within the purview of the invention.

While the preferred embodiments of the present invention have been described, it should be understood that various changes, adaptions and modifications may be made therein without departing from the spirit of the invention and the scope of the appended claims.

What is claimed is:

1. An in-line roller skate usable by a skater on a riding surface comprising:

at least three wheels, each wheel having a central axis of rotation;

at least three wheel axles having predetermined lengths, an axle being positioned on said central axis of each said wheel;

a frame carrying said axles so as to rotatably mount said plurality of wheels on said frame and to substantially center all said wheels on a common plane with the axes of rotation of said wheels being substantially perpendicular to said common plane;

attachment means connected to said frame capable of releasably securing said frame to the skater;

each of said wheels including a tire member, a hub, and bearing means carried by said hub and supported on a said wheel axle;

said bearing means including an inner and outer race;

said frame including a plurality of axle apertures, each aperture having an upper edge, said apertures being arranged in pairs with the two apertures of each pair confronting each other and being positioned on a said wheel axis of rotation;

a plurality of axle aperture plugs, a said plug mateably engaging each said axle aperture to retain said plugs in said apertures during insertion of said wheels between said plugs, each said plug including a spacer engaging said bearing inner race and spacing said outer race of said bearing means from said frame while avoiding slippage and dislocation of said plug relative to said frame during installation of each of said wheels, each of said axle aperture plugs having a transverse axle bore therethrough coaxial with a said axle and coaxial with the said central axis of rotation of a said wheel;

each said axle and the said coaxial axle bore of said axle aperture plug having cooperating cross sections allowing said entire length of said axle to be slideably insertable through said coaxial axle bores of a pair of said axle aperture plugs and through said inner race of said bearing means positioned between said pair of axle aperture plugs having coaxial axle bores; and clamping means on each said axle for attaching said axle to said frame and clamping said plugs and said inner races of said bearing means within said frame.

2. The in-line roller skate of claim 1 wherein each said axle aperture and plug includes anti-rotation means to prevent free rotation of said plug in said axle aperture, said axle bore of each axle aperture plug being round and the cross section of each axle being round for the entire length of said axle and closely, slideably confronting said coaxial axle bores of a pair of axle aperture plugs.

3. The in-line roller skate of claim 1 wherein said frame is an integral frame having left and right side rails which are fixed and immovable relative to each other and remain fixed and immovable during installation and removal of said wheels and said axles.

4. A method for installing an in-line roller skate wheel, a bearing spacer, first and second bearings having inner and outer races, and axle aperture plugs between left and right side rails of a skate frame so as to more easily insert an axle of given uniform cross section where the side rails have coaxially aligned axle apertures with the apertures significantly larger than the cross section of the axle, and the axle aperture plugs have axle bores just large enough to slideably receive the axle, comprising the steps of:

inserting a plug within the axle aperture of the left side rail in a first orientation and a plug in the axle aperture of the right side rail in a first orientation;

limiting the depth of penetration of the axle aperture plugs in the axle apertures so the plugs are retained in the apertures with the plugs protruding from the apertures and confronting each other so as to define a spacer adjacent each side rail;

inserting the first and second bearings within the wheel with the bearing spacer between the bearings so the inner races and bearing spacer are coaxial;

positioning the wheel between the two plugs so the bearing inner races are coaxial with the axle bores of the plugs;

inserting the axle through the axle bore of the plug in the first side rail, through the inner races and bearing spacer and through the axle bore of the plug in the second side rail so the axles are a first distance from the top of the aperture; and clamping the side rails to urge the plugs on each axle together to clamp the inner races of each bearing between the plugs and the bearing spacer so the outer races of the bearing can rotate freely between the side rails.

5. An in-line roller skate usable by a skater on a riding surface comprising:

at least three wheels, each wheel having a central axis of rotation;

at least three wheel axles having predetermined lengths, an axle being positioned on said central axis of each said wheel;

a frame carrying said axles so as to rotatably mount said plurality of wheels on said frame and to substantially center all said wheels on a common plane with the axes of rotation of said wheels being substantially perpendicular to said common plane;

attachment means connected to said frame capable of releasably securing said frame to the skater;

each of said wheels including a tire member, a hub, and bearing means carried by said hub and supported on a said wheel axle;

said bearing means including an inner and outer race;

said frame including a plurality of axle apertures, each aperture having an upper edge, said apertures being arranged in pairs with the two apertures of each pair confronting each other and being positioned on a said wheel axis of rotation;

a plurality of axle aperture plugs, a said plug mateably engaging each said axle aperture to retain said plugs in said apertures during insertion of said wheels between said plugs, each said plug including a spacer engaging said bearing inner race and spacing said outer race of said bearing means from said frame while avoiding slippage and dislocation of said plug relative to said frame during installation of each of said wheels, each of said axle aperture plugs having a transverse axle bore therethrough coaxial with a said axle and coaxial with the said central axis of rotation of a said wheel;

each said axle and the said coaxial axle bore of said axle aperture plug having cooperating cross sections allowing said entire length of said axle to be slideably insertable through said coaxial axle bores of a pair of said axle aperture plugs and through said inner race of said bearing means positioned between said pair of axle aperture plugs having coaxial axle bores; and clamping means on each said axle for attaching said axle to said frame and clamping said plugs and said inner races of said bearing means within said frame each said axle aperture and plug includes anti-rotation means to prevent free rotation of said plug in said axle aperture, said axle bore of each axle aperture plug being round and the cross section of each axle being round for the entire length of said axle and closely, slideably confronting said coaxial axle bores of a pair of axle aperture plugs; and said anti-rotation means includes a lug insertable within said axle aperture, said axle bore of said plug being eccentrically positioned on said lug, said axle bore receiving said axle so that when said lug is inserted in said aperture in a first orientation, said axle bore is a first distance below said upper edge of said axle aperture, and when said lug is inserted in said aperture in a second orientation, said axle bore is at a second distance below said upper edge, said second distance being greater than said first distance, thereby permitting at least one axle and wheel to be at a level lower than the remaining wheels, so as to permit riding on said skate with said skate supported on the riding surface by said lower wheel and one other of said wheels so as to increase maneuverability and speed of the skate.

6. A method for installing an in-line roller skate wheel, a bearing spacer, first and second bearings having inner and outer races, and axle aperture plugs between left and right side rails of a skate frame so as to more easily insert an axle of given uniform cross section where the side rails have coaxially aligned axle apertures with the apertures significantly larger than the cross section of the axle, and the axle aperture plugs have axle bores just large enough to slidably receive the axle, comprising the steps of:

inserting a plug within the axle aperture of the left side rail in a first orientation and a plug in the axle aperture of the right side rail in a first orientation;

limiting the depth of penetration of the axle aperture plugs in the axle apertures so the plugs are retained in the apertures with the plugs protruding from the apertures and confronting each other so as to define a spacer adjacent each side rail;

inserting the first and second bearings within the wheel with the bearing spacer between the bearings so the inner races and bearing spacer are coaxial;

positioning the wheel between the two plugs so the bearing inner races are coaxial with the axle bores of the plugs;

inserting the axle through the axle bore of the plug in the first side rail, through the inner races and bearing spacer and through the axle bore of the plug in the second side rail so the axles are a first distance from the top of the aperture; and clamping the side rails to urge the plugs on each axle together to clamp the inner races of each bearing between the plugs and the bearing spacer so the outer races of the bearing can rotate freely between the side rails; and the axle aperture plugs have the axle bore positioned eccentrically thereon and further including the step of:

changing the distance between the axle bores and the top of the apertures by rotating at least one pair of axle aperture plugs about the eccentrically positioned axle bore of the plugs and inserting the pair of plugs in the axle apertures to thereby position at least one wheel at a level below the remaining wheels.

* * * * *